US010738455B2

(12) United States Patent
Burkhart, Sr. et al.

(10) Patent No.: US 10,738,455 B2
(45) Date of Patent: Aug. 11, 2020

(54) METHOD AND APPARATUS FOR FLUID RETENTION OR DETENTION

(71) Applicants: Kurt A. Burkhart, Sr., North Granby, CT (US); Ronald E. Burkhart, Sr., Southwick, MA (US)

(72) Inventors: Kurt A. Burkhart, Sr., North Granby, CT (US); Ronald E. Burkhart, Sr., Southwick, MA (US)

(73) Assignee: Retain-It, LLC, Granby, CT (US)

( * ) Notice: Subject to any disclaimer, the term of this patent is extended or adjusted under 35 U.S.C. 154(b) by 381 days.

(21) Appl. No.: 15/236,843

(22) Filed: Aug. 15, 2016

(65) Prior Publication Data

US 2016/0348350 A1 Dec. 1, 2016

Related U.S. Application Data

(63) Continuation of application No. 12/395,182, filed on Feb. 27, 2009, now Pat. No. 9,441,355.

(51) Int. Cl.

| | |
|---|---|
| ***E02B 11/00*** | (2006.01) |
| ***E03F 1/00*** | (2006.01) |
| ***E03F 5/10*** | (2006.01) |

(52) U.S. Cl.

CPC ..... *E03F 1/005* (2013.01); *E03F 1/002* (2013.01); *E03F 5/10* (2013.01)

(58) Field of Classification Search

CPC ..... E03F 1/003; E03F 1/005; B21D 21/0042; B21D 21/0045; B21D 21/0048

USPC ..... 405/36, 39, 42–47, 51; 52/88, 169.2; 210/170.01, 170.03, 170.08

See application file for complete search history.

(56) References Cited

U.S. PATENT DOCUMENTS

| | | | | | |
|---|---|---|---|---|---|
| 836,386 | A | * | 11/1906 | Keegan | B01D 21/0039 210/320 |
| 1,394,780 | A | * | 10/1921 | Nicholas | C02F 3/02 138/42 |
| 2,866,319 | A | * | 12/1958 | Nicholson | E03F 1/003 210/322 |
| 2,941,635 | A | | 6/1960 | Harris | |
| 3,339,366 | A | | 9/1967 | Gogan et al. | |
| 3,416,321 | A | * | 12/1968 | Saad | E03F 1/003 405/46 |
| 3,579,995 | A | | 5/1971 | Flynn | |
| 3,645,100 | A | | 2/1972 | La Monica | |
| 3,910,051 | A | | 10/1975 | Komisarek | |

(Continued)

FOREIGN PATENT DOCUMENTS

| | | | | |
|---|---|---|---|---|
| CA | 2445609 | A1 * | 4/2004 | E03F 1/005 |
| CA | 2450565 | A1 * | 9/2004 | E03F 1/003 |

(Continued)

*Primary Examiner* — Tara Mayo-Pinnock

(74) *Attorney, Agent, or Firm* — St. Onge Steward Johnston & Reens, LLC

(57) ABSTRACT

In a system and method for retaining or detaining a fluid beneath a ground surface, a plurality of modules, each having at least one vertically disposed side portion supporting a horizontally disposed roof are provided. The plurality of modules, each being in fluid communication, either directly or indirectly, with each of the other modules, are arranged in an assembly having a plurality of rows and columns. Each of the rows and columns contain at least one flow obstructer such that fluid flow through each of the rows and columns is circuitous.

15 Claims, 14 Drawing Sheets

(56) References Cited

U.S. PATENT DOCUMENTS

| | | | | |
|---|---|---|---|---|
| 4,313,692 | A | 2/1982 | Johnson | |
| 4,854,775 | A | 8/1989 | Lockwood | |
| 5,004,534 | A * | 4/1991 | Buzzelli | B01D 21/003 210/164 |
| 5,419,838 | A * | 5/1995 | DiTullio | E03B 11/14 210/155 |
| 5,890,838 | A | 4/1999 | Moore, Jr. et al. | |
| 6,922,950 | B2 | 8/2005 | Heierli | |
| 6,991,402 | B2 | 1/2006 | Burkhart | |
| 7,160,058 | B2 | 1/2007 | Burkhart | |
| 7,344,335 | B2 | 3/2008 | Burkhart | |
| 7,833,413 | B1 | 11/2010 | Rotondo et al. | |
| 8,142,666 | B1 * | 3/2012 | Happel | B01D 21/003 210/170.03 |
| 2004/0076473 | A1 | 4/2004 | Burkhart | |
| 2004/0222159 | A1 * | 11/2004 | Peters, Jr. | B01J 39/14 210/688 |
| 2005/0109707 | A1 * | 5/2005 | Bryant | B01D 21/0012 210/747.3 |
| 2006/0034662 | A1 | 2/2006 | Burkhart | |

FOREIGN PATENT DOCUMENTS

| | | | | |
|---|---|---|---|---|
| EP | 1932974 | A1 * | 6/2008 | E03F 1/005 |
| EP | 1932975 | A1 * | 6/2008 | E03F 1/005 |
| FR | 2917384 | A1 * | 12/2008 | E03B 3/03 |
| WO | WO 8002854 | A1 * | 12/1980 | E03F 1/003 |

* cited by examiner

METHOD AND APPARATUS FOR FLUID RETENTION OR DETENTION

FIELD OF THE INVENTION

The present invention relates generally to systems and methods for the detention or retention of a fluid, and more specifically to systems and methods for the detention or retention of storm water or runoff beneath a ground surface.

BACKGROUND OF THE INVENTION

Traditionally, large storm sewers, with or without surface detention basins, have been used for handling excess storm water or runoff. However, in urban or industrial settings, the surface area on the building site is often not available or it is cost prohibitive to purchase additional surface area to accommodate systems such as open reservoirs, basins, or ponds for detaining or retaining water. Underground systems are therefore desirable because they do not utilize valuable surface areas and present fewer adverse environmental effects than other systems. In addition, underground systems are also not susceptible to the aesthetic problems, such as algae and weed growth, associated with some surface-level systems.

Many other applications exist for subsurface modular assemblies for detaining or retaining a fluid. For example, a large volume of water may be retained underground for firefighting purposes or manufacturing processing. In addition, underground storage assemblies may be used for chemical containment. Even further, these underground systems may be used as leaching chambers or for controlled release of storm water beneath the ground surface. Therefore, for ease of manufacture and installation, it is desirable to have a system that can be easily converted from a fluid retaining, to a fluid detaining, to a fluid exfiltrating system.

One problem associated with current underground systems is that, by nature, they are difficult to clean and often become clogged with debris. It is therefore desirous to provide a system that is self-cleaning and resistant to clogging and degradation caused by sand, dirt, natural materials and other debris which may be carried along with the water.

It is also desirable to have a versatile and modular assembly that may be assembled in any customized orientation to suit any plan area or footprint as desired by the particular application involved. In particular, for systems that are intended for diverting a fluid such as storm water from the ground surface to another location, the system must be able to accommodate existing or planned underground facilities such as utilities and other buried conduits.

In addition, underground systems must be adapted to resist loads imposed by other uses of the surface of the land, including the imposed by the load of the earth surrounding the system. The surface area of the land may then be used for motor vehicle parking or driving, foot traffic, an airport runway, or the like.

While other forms of underground fluid detention and/or retention structures have previously been proposed, these structures have failed to provide one or more of the above advantages.

SUMMARY OF THE INVENTION

Accordingly, it is an object of the present invention to provide a versatile system for retaining or detaining a fluid which can be easily customized to many applications.

It is a further object of the present invention to provide a system for retaining or detaining a fluid that is structurally sound, especially at the interior of the system.

It is a further object of the present invention to provide a system for retaining or detaining water that is less susceptible to clogging by debris and is self-cleaning.

These and other objects and advantages are achieved by providing a fluid retention or detention system comprising a plurality of modules, each module, which may be formed from precast concrete, having at least one vertically disposed side portion supporting a horizontally disposed roof. The plurality of modules are arranged in an assembly having a plurality of rows and columns, each of the plurality of modules in the assembly are in fluid communication, either directly or indirectly, with each of the other modules. Each of the rows and columns contain at least one flow obstructer such that fluid flow through each of the rows and columns is circuitous. In some embodiments, the flow obstructer may be a wall having substantially no holes.

In some embodiments, the plurality of modules comprise at least one first module having at least one side portion defining a fluid passage extending therethrough. In further embodiments, the plurality of modules comprises at least one second module having at least one side portion defining substantially no openings and at least one side portion defining a fluid passage extending therethrough. Each fluid passage may have about the same cross section and extend upward from the bottom edges of each module. In some embodiments, the fluid passage may have a generally inverted U-shaped cross section.

The plurality of modules may further comprise at least one third module having at least two side portions defining substantially no openings and at least one side portion defining a fluid passage extending therethrough. An outer boundary may be defined by at least some of the second and third modules are peripherally located in the assembly. In further embodiments, the side portions of the second and third modules defining substantially no openings face the exterior of said assembly. The assembly of the fluid retention or detention system may be supported on an impermeable floor. Alternatively, the assembly of the fluid retention or detention system may be supported on a floor having at least one outlet port defined therein.

In one aspect of the invention, a fluid retention or detention system comprising a plurality of interior modules, each having at least one vertically disposed side portion supporting a horizontally disposed roof and a plurality of exterior modules, each having at least one vertically disposed side portion supporting a horizontally disposed roof is provided. The plurality of interior and exterior modules are arranged in an assembly in a plurality of rows and columns with the plurality of exterior modules being peripherally located in the assembly with respect to the interior modules so as to define an outer boundary. The plurality of interior modules may be arranged adjacent each other in the assembly. Each of the plurality of modules in the assembly are in fluid communication, either directly or indirectly, with each of the other modules. Each of the rows and columns containing at least one flow obstructer such that fluid flow through each of said rows and columns is circuitous. The flow obstructer may comprise a wall having substantially no holes.

In some embodiments, each of the plurality of interior modules has at least one side portion defining a fluid passage extending therethrough. Each fluid passage may have about the same cross section and extend upward from the bottom edges of each module. In some embodiments, the fluid passage may have a generally inverted U-shaped cross section. At least one of the plurality of interior modules may have one side portion having substantially no openings or may have two side portions having substantially no openings.

In another embodiment, each of the plurality of exterior modules has at least one side portion defining a fluid passage extending therethrough. Each of the plurality of exterior modules may have at least one side portion defining substantially no openings, which may further face the exterior of the assembly. In yet another embodiment, each of the plurality of exterior modules has at least one side portion defining a plurality of perforations, which may face the exterior of the assembly. The perforations, which may be selectively closed, may be a hole having a diameter no larger than two (2) inches. A water-tight liner may be used to selectively close the perforations.

In another aspect of the invention, a method for detaining or retaining a fluid beneath a ground surface comprising the steps of (1) placing within the ground, a first level comprising a plurality of modules, each module having at least one vertically disposed side portion supporting a horizontally disposed roof; (2) arranging the plurality of modules in an assembly having a plurality of rows and columns; and (3) providing each of the rows and columns with at least one flow obstructer such that fluid flow through each of the rows and columns is circuitous. Each of the plurality of modules in the assembly are in fluid communication, either directly or indirectly, with each of the other modules. The flow obstructer may be a wall having substantially no holes.

In some embodiments, the plurality of modules comprises at least one first module having at least one side portion defining a fluid passage extending therethrough. In other embodiments, the plurality of modules comprises at least one second module having at least one side portion defining substantially no openings and at least one side portion defining a fluid passage extending therethrough. In further embodiments, the plurality of modules comprises at least one third module having at least two side portions defining substantially no openings and at least one side portion defining a fluid passage extending therethrough.

The method may further comprise the step of peripherally arranging at least some of the second and third modules of the first level in said assembly so as to define an outer boundary. At least some of the second and third modules of the first level may be peripherally arranged in the assembly so that the side portions defining substantially no openings face the exterior of the assembly. The first level of the assembly may be supported on an impermeable floor. Alternatively, the first level may be supported on a floor having at least one outlet port defined therein.

In other embodiments, some of the first and second modules may be provided with at least one side portion defining a plurality of perforations. The method may further comprise the step of peripherally arranging these first and second modules of the first level in the assembly so the said side portions defining a plurality of perforations face the exterior of the assembly. The plurality of perforations may be selectively closed by providing a water-tight liner around the assembly.

In yet another aspect of the invention, the method may further comprise the steps of: (1) placing a second level within the ground comprising a plurality of modules, each module having at least one vertically disposed side portion supporting a horizontally disposed roof; (2) arranging the plurality of modules in an assembly having a plurality of rows and columns; and (3) providing each of said rows and columns with at least one flow obstructer such that fluid flow through each of said rows and columns is circuitous. Each of the plurality of modules in the assembly are in fluid communication, either directly or indirectly, with each of the other modules. The second level is supported by said first level in vertical alignment.

DETAILED DESCRIPTION OF THE INVENTION

Figure 1:
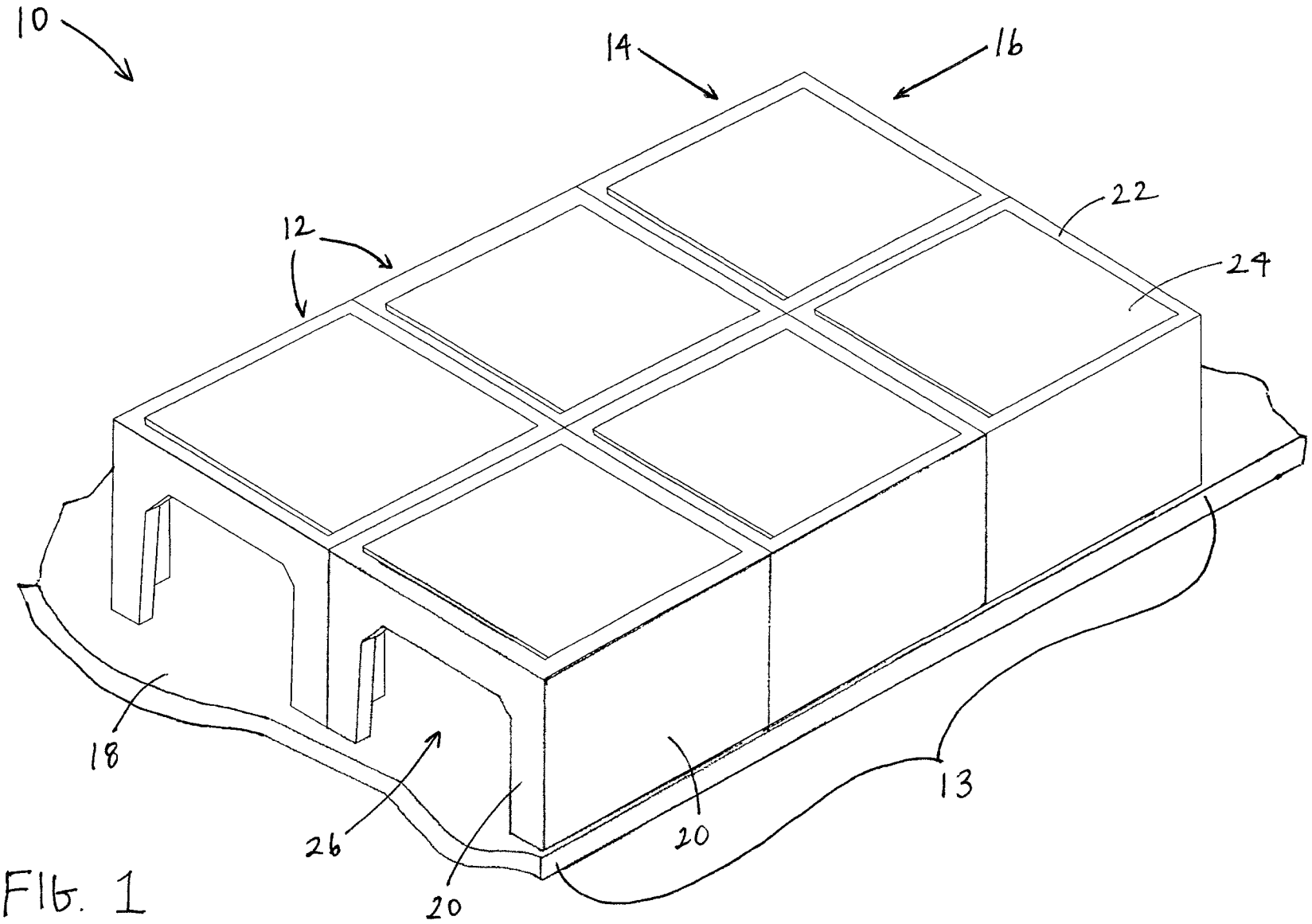
FIG. 1 is a perspective view of one embodiment of the fluid retention or detention system of the present invention.
Figure 2B:
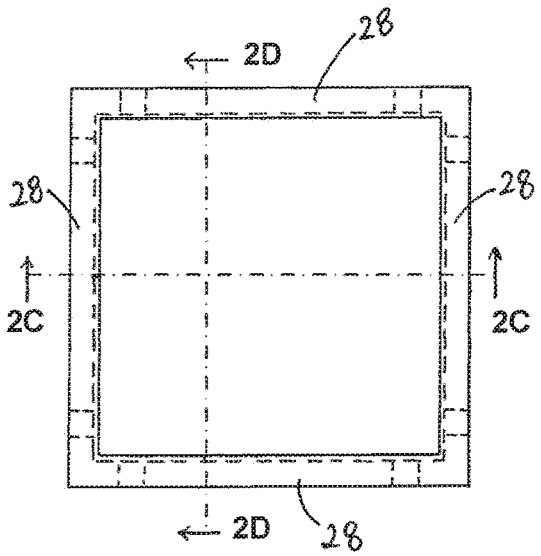
FIG. 2B is a top view of one embodiment of a module as used in the fluid retention or detention system of the present invention.
Figure 2A:
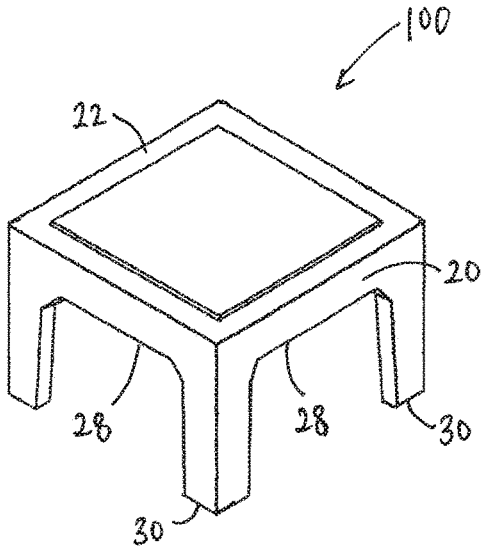
FIG. 2A is a perspective view of one embodiment of a module as used in the fluid retention or detention system of the present invention.
Figure 2C:
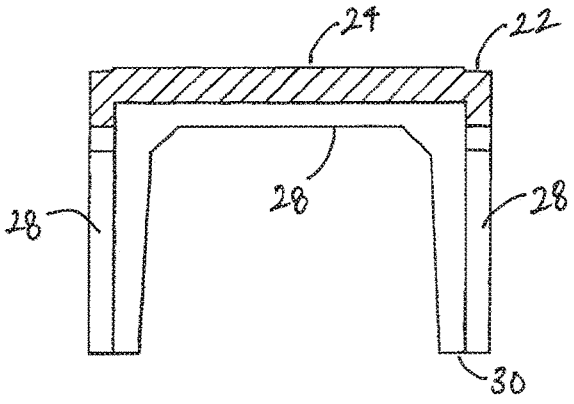
FIG. 2C is a side sectional view of one embodiment of a module as used in the fluid retention or detention system of the present invention taken along line 2C-2C.
Figure 2D:
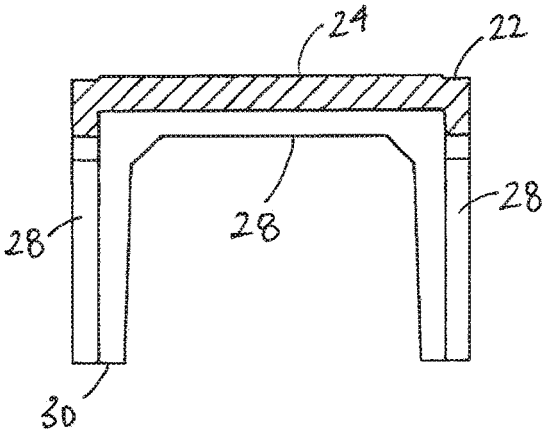
FIG. 2D is a side sectional view of one embodiment of a module as used in the fluid retention or detention system of the present invention taken along line 2D-2D.
Figure 3B:
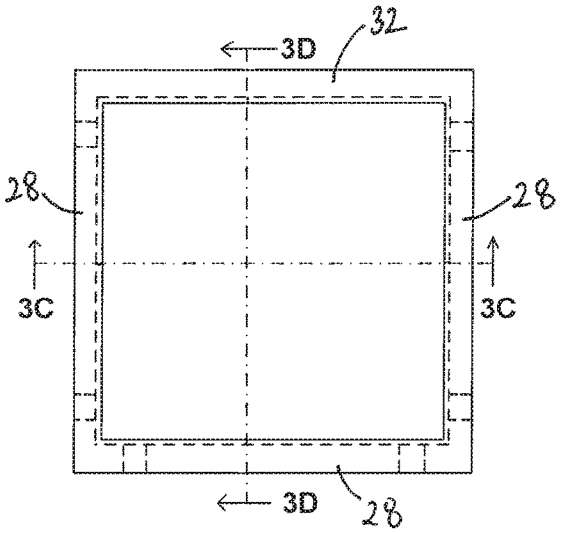
FIG. 3B is a top view of one embodiment of a module as used in the fluid retention or detention system of the present invention.
Figure 3A:
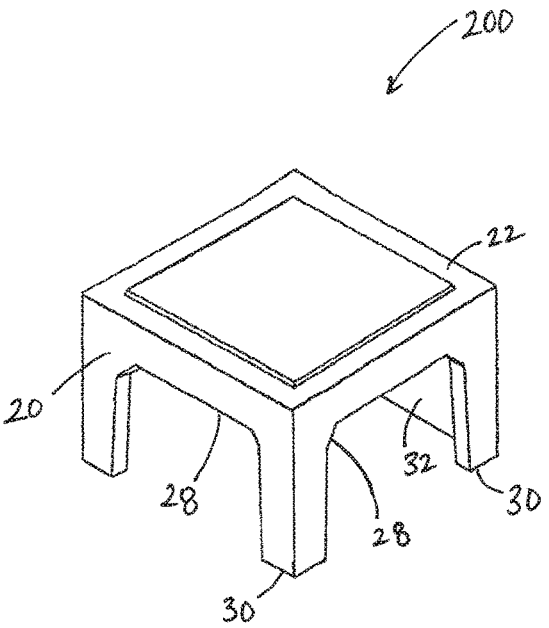
FIG. 3A is a perspective view of one embodiment of a module as used in the fluid retention or detention system of the present invention.
Figure 3C:
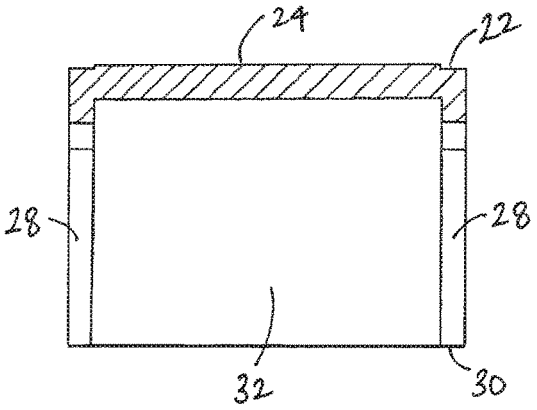
FIG. 3C is a side sectional view of one embodiment of a module as used in the fluid retention or detention system of the present invention taken along line 3C-3C.
Figure 3D:
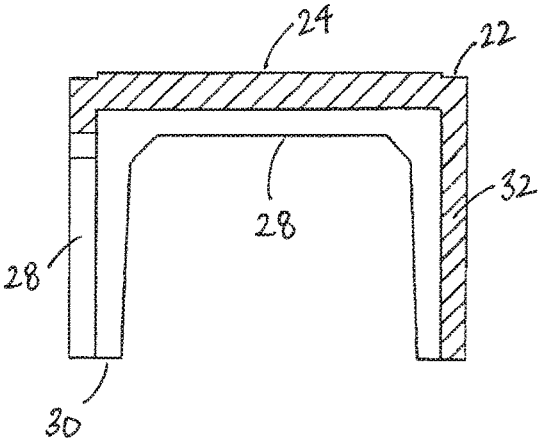
FIG. 3D is a side sectional view of one embodiment of a module as used in the fluid retention or detention system of the present invention taken along line 3D-3D.
Figure 4B:
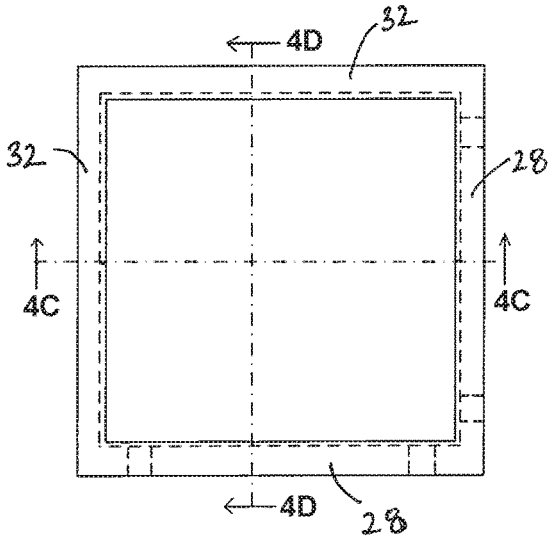
FIG. 4B is a top view of one embodiment of a module as used in the fluid retention or detention system of the present invention.
Figure 4A:
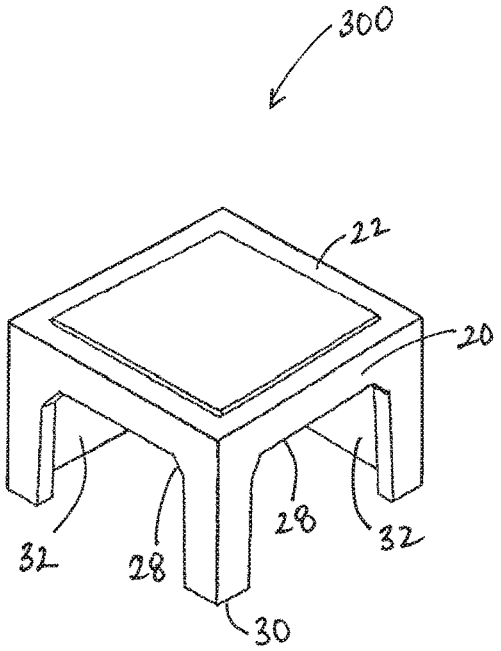
FIG. 4A is a perspective view of one embodiment of a module as used in the fluid retention or detention system of the present invention.
Figure 4C:
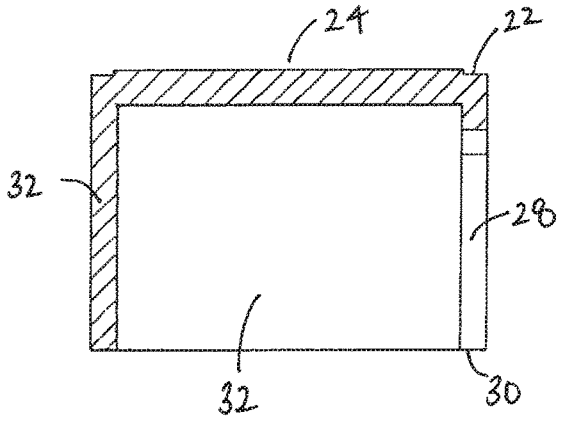
FIG. 4C is a side sectional view of one embodiment of a module as used in the fluid retention or detention system of the present invention taken along line 4C-4C.
Figure 4D:
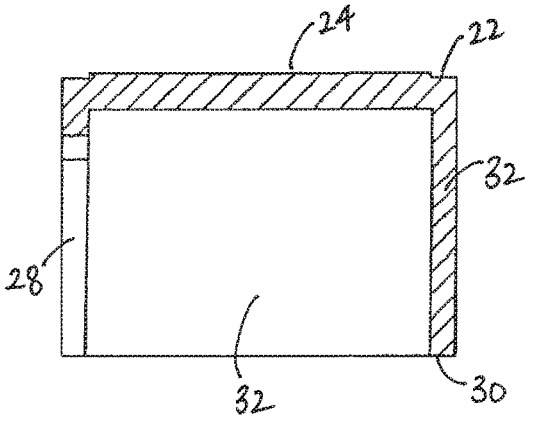
FIG. 4D is a side sectional view of one embodiment of a module as used in the fluid retention or detention system of the present invention taken along line 4D-4D.
Figure 5B:
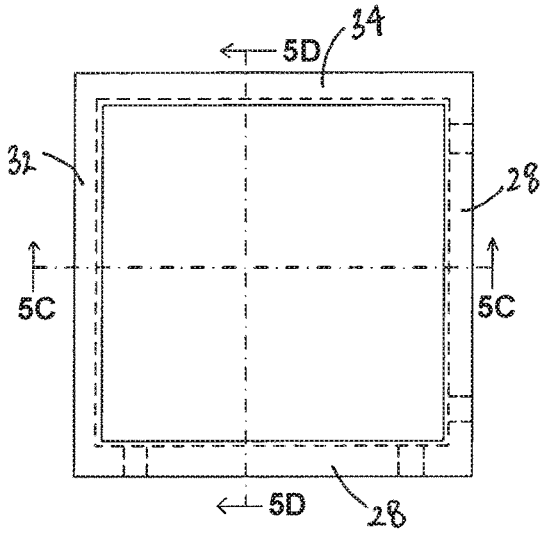
FIG. 5B is a top view of one embodiment of a module as used in the fluid retention or detention system of the present invention.
Figure 5A:
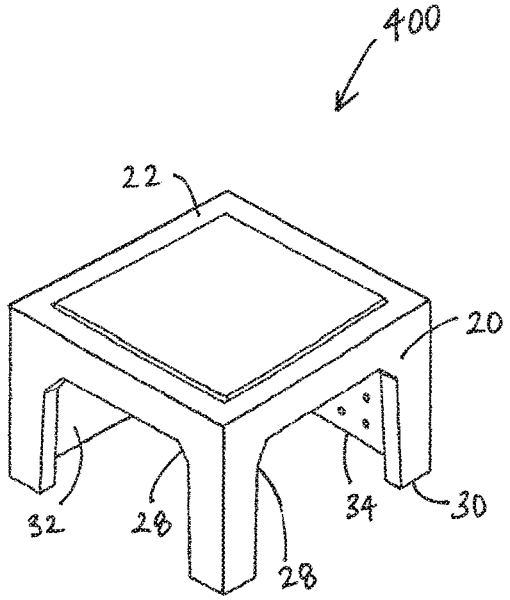
FIG. 5A is a perspective view of one embodiment of a module as used in the fluid retention or detention system of the present invention.
Figure 5C:
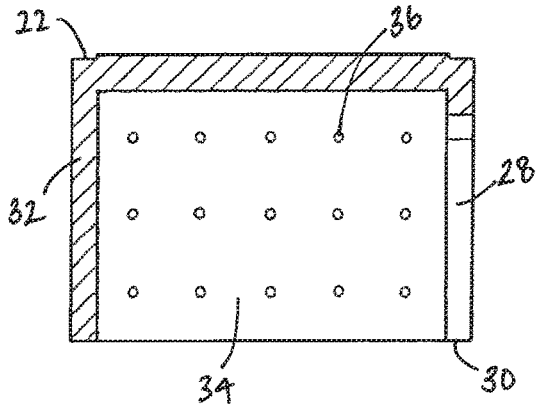
FIG. 5C is a side sectional view of one embodiment of a module as used in the fluid retention or detention system of the present invention taken along line 5C-5C.
Figure 5D:
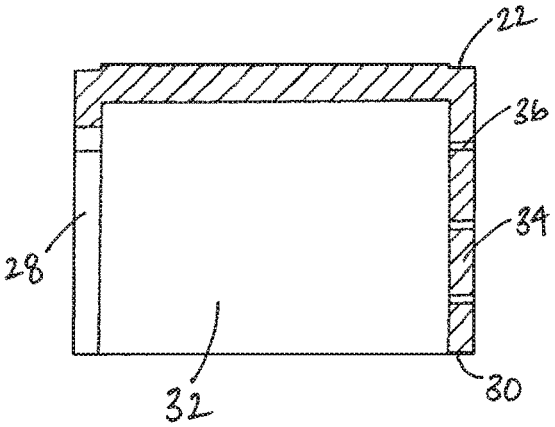
FIG. 5D is a side sectional view of one embodiment of a module as used in the fluid retention or detention system of the present invention taken along line 5D-5D.
Figure 6B:
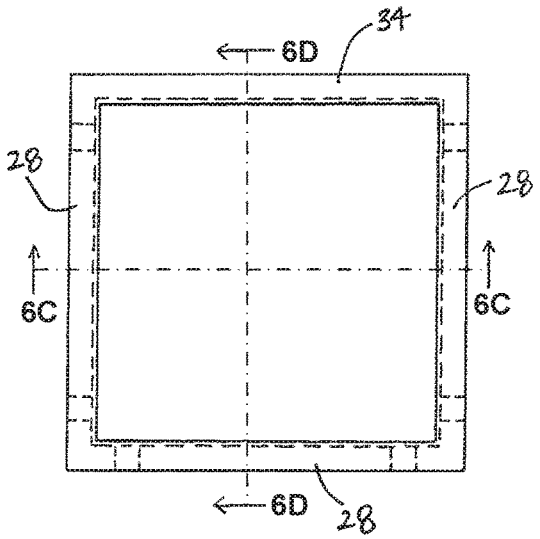
FIG. 6B is a top view of one embodiment of a module as used in the fluid retention or detention system of the present invention.
Figure 6A:
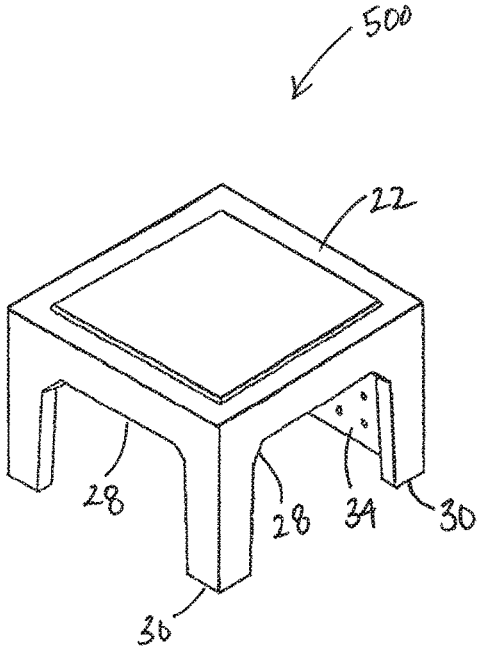
FIG. 6A is a perspective view of one embodiment of a module as used in the fluid retention or detention system of the present invention.
Figure 6C:
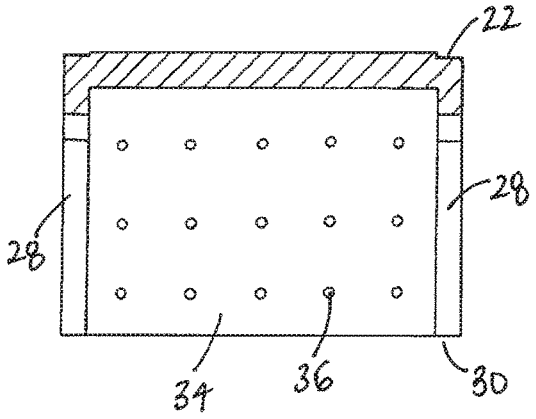
FIG. 6C is a side sectional view of one embodiment of a module as used in the fluid retention or detention system of the present invention taken along line 6C-6C.
Figure 6D:
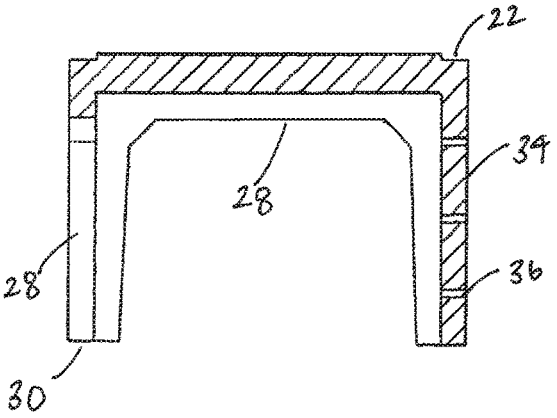
FIG. 6D is a side sectional view of one embodiment of a module as used in the fluid retention or detention system of the present invention taken along line 6D-6D.
Figure 7B:
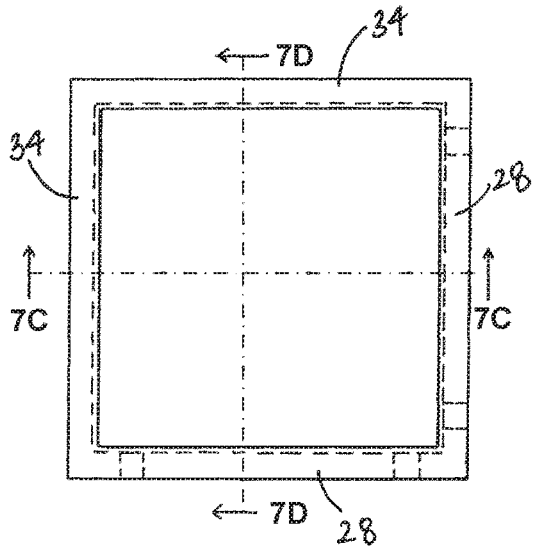
FIG. 7B is a top view of one embodiment of a module as used in the fluid retention or detention system of the present invention.
Figure 7A:
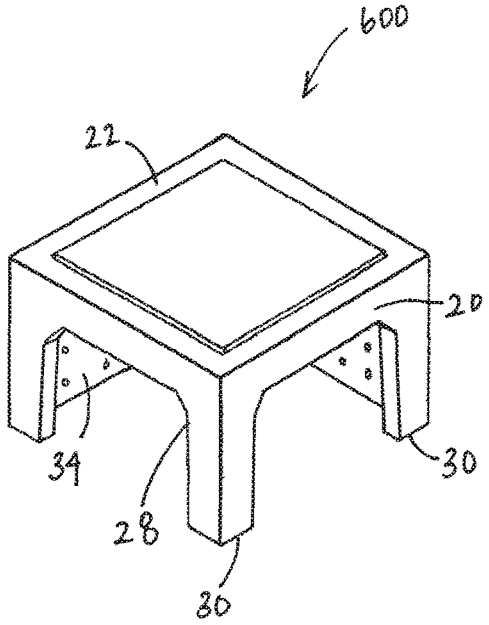
FIG. 7A is a perspective view of one embodiment of a module as used in the fluid retention or detention system of the present invention.
Figure 7C:
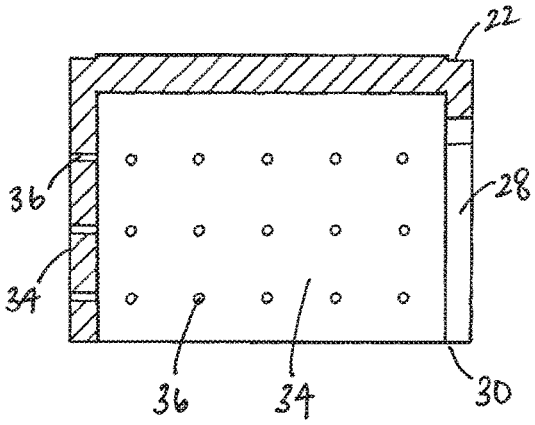
FIG. 7C is a side sectional view of one embodiment of a module as used in the fluid retention or detention system of the present invention taken along line 7C-7C.
Figure 7D:
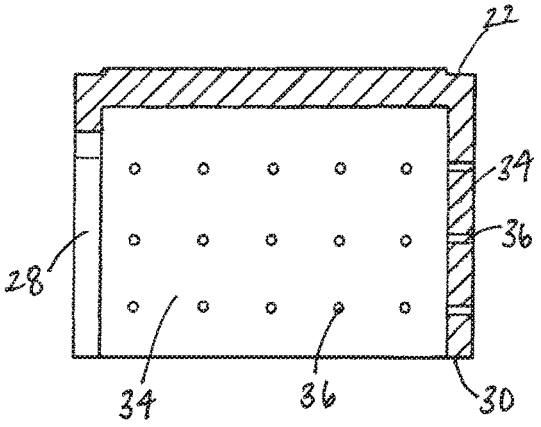
FIG. 7D is a side sectional view of one embodiment of a module as used in the fluid retention or detention system of the present invention taken along line 7D-7D.

One embodiment of the fluid retention or detention system 10 of the present invention is shown in FIG. 1. The system 10 generally comprises a plurality of modules 12 that are arranged together in an assembly 13 having a plurality of rows 14 and columns 16. Each module generally comprises at least one vertically disposed side portion 20 supporting a horizontally disposed roof 22. The roof 22 may be provided with a raised portion 24, the utility of which will be described below. The at least one side portion 20 and roof 22 define a chamber 26 which occupies a relatively large proportion of the area of the module. This design permits a maximum amount of internal fluid storage in comparison to the plan area or footprint occupied by each module.

Preferably, the modules 12 are made of precast concrete having a high strength with the side portion 20 and roof 22 of each module preferably formed as one integral piece. The modules may be formed with embedded reinforcements such as steel reinforcing rods, prefabricated steel mesh, metal or plastic fibers or ribbons, or other similar reinforcements.

The modules 12 of the present invention may be provided in any one of a variety of embodiments, each having a distinct purpose and providing a particular advantage. The particular elements of each embodiment will now be described and their utility within the system will be described thereafter.

FIGS. 2A-2D depict a first embodiment of a module 100 in which all of the side portions 24 define a fluid passage 28 extending therethrough. In some embodiments, fluid passage 28 extends upward from a bottom edge 30 of the module 100, allowing for relatively unconstrained flow of fluid through the module 100. In this embodiment, the fluid passage 28 generally has an inverted U-shape.

FIGS. 3A-3D depict a second embodiment of a module 200 in which three side portions 24 define a fluid passage 28. One side portion 24 defines a solid wall 32 having substantially no openings.

FIGS. 4A-4D depict a third embodiment of a module 300 in which two side portions 24 define a fluid passage 28 and two side portions define a solid wall 32.

FIGS. 5A-5D depict a fourth embodiment of a module 400 in which two side portions 24 define a fluid passage 28, one side portion 24 defines a solid wall 32, and one side portion 24 defines a perforate wall 34 having a plurality of perforations 36. The perforations 36 may generally take any shape and size which allow for a controlled release of fluid through the holes. Preferably, the perforations 36 are holes having a diameter no larger than two (2) inches each. This size is large enough to allow for a release of the fluid into the surrounding earth, but is small enough so that the fluid will not flow out so fast as to saturate the soil and cause flooding.

FIGS. 6A-6D depict a fifth embodiment of a module 500 having three side portions 24 which define a fluid passage 28 and one side portion 24 which defines a perforate wall 34 having a plurality of perforations 36.

FIGS. 7A-7D depict a sixth embodiment of a module 600 in which three side portions 24 define a fluid passage 28 and one side portion 24 defines a perforate wall 34 having a plurality of perforations 36.

Depending on the preferred configuration and use of the system 10, notch outlet 38, shown in FIGS. 8A-8D, may be provided in the side portion 24 of one or more modules. In the pictured embodiment, notch outlet 38 is a V-notch outlet, but it will be understood that notch outlet 38 could take any number of shapes. The purpose of notch outlet 38 is to allow a controlled or regulated release of fluid from the system 10. If the water level within the system is lower than the base 40 of the notch outlet 38, no fluid will be released from the system. Thus, the height of the outlet 38 can be adjusted to allow for controlled release at higher or lower fluid levels. As the water level rises above the base 40 of the notch outlet 38, fluid will begin to escape from the system 10 and will do so at a controlled, yet increasing rate.

Figure 8B:
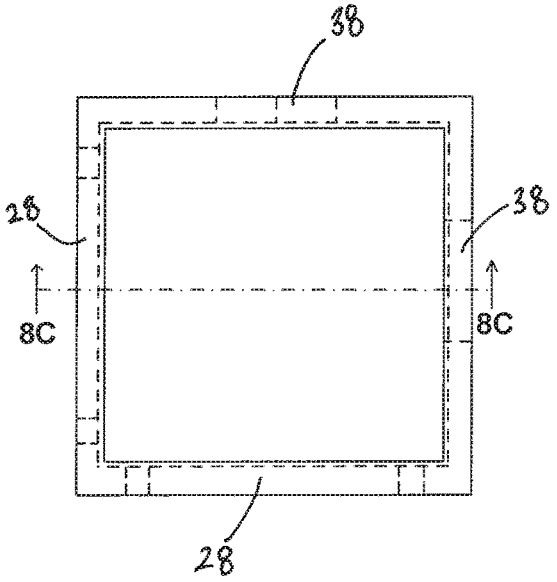
FIG. 8B is a top view of one embodiment of a module as used in the fluid retention or detention system of the present invention.
Figure 8A:
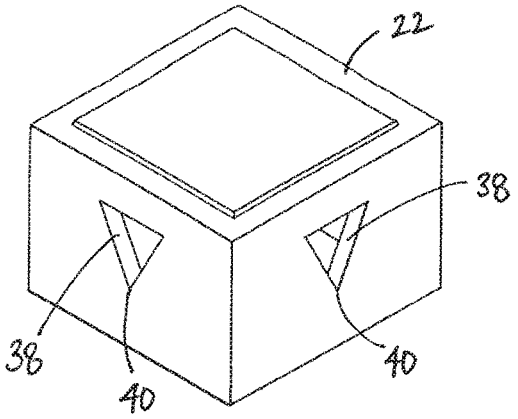
FIG. 8A is a perspective view of one embodiment of a module as used in the fluid retention or detention system of the present invention.
Figure 8C:
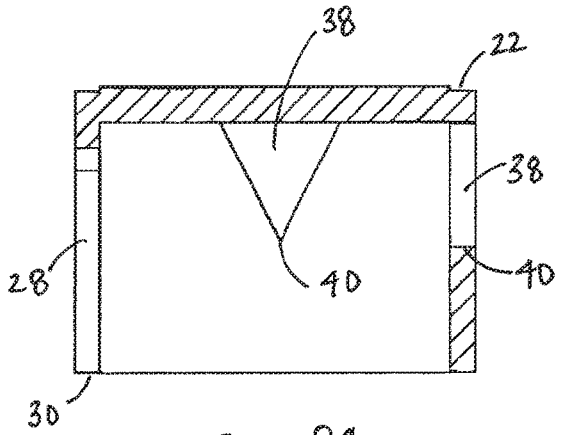
FIG. 8C is a side sectional view of one embodiment of a module as used in the fluid retention or detention system of the present invention taken along line 8C-8C.
Figure 8D:
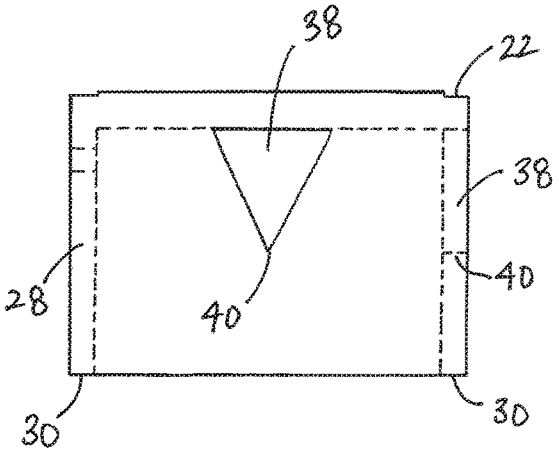
FIG. 8D is a side, phantom view of one embodiment of a module as used in the fluid retention or detention system of the present invention.
Figure 9B:
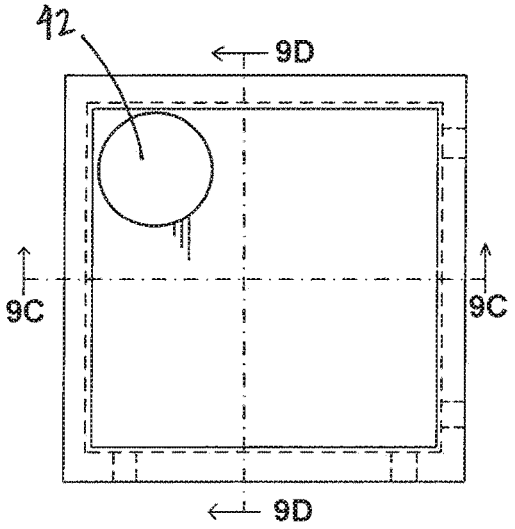
FIG. 9B is a top view of one embodiment of a module as used in the fluid retention or detention system of the present invention.
Figure 9A:
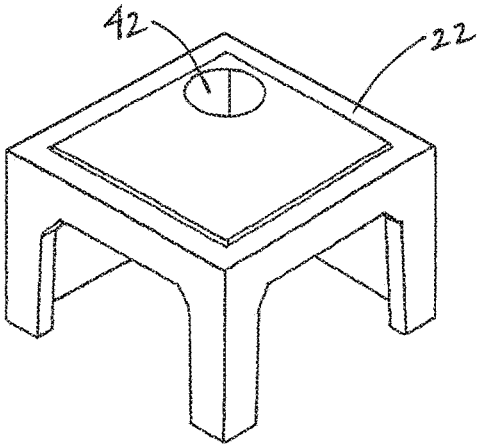
FIG. 9A is a perspective view of one embodiment of a module as used in the fluid retention or detention system of the present invention.
Figure 9C:
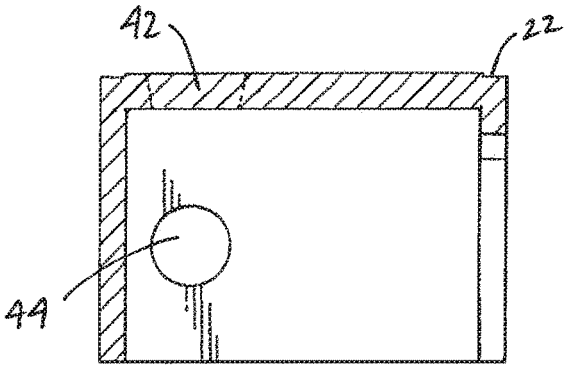
FIG. 9C is a side sectional view of one embodiment of a module as used in the fluid retention or detention system of the present invention taken along line 9C-9C.
Figure 9D:
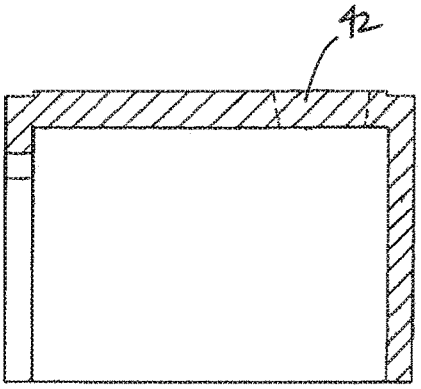
FIG. 9D is a side sectional view of one embodiment of a module as used in the fluid retention or detention system of the present invention taken along line 9D-9D.
Figure 10A:
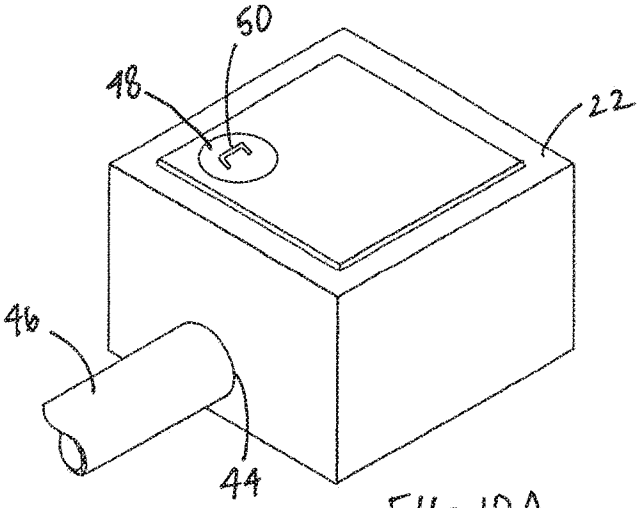
FIG. 10A is a perspective view of one embodiment of a module as used in the fluid retention or detention system of the present invention.
Figure 10D:
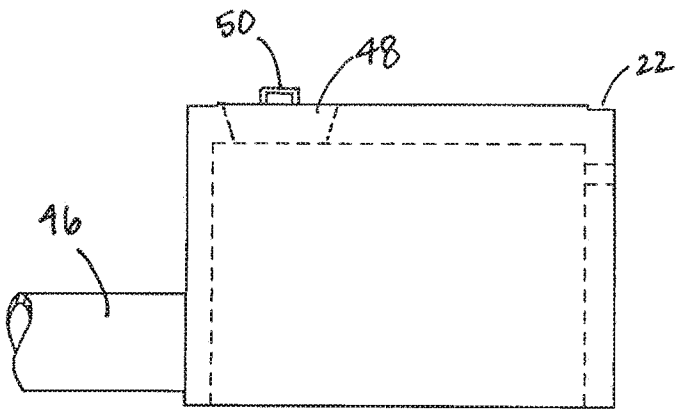
FIG. 10D is a side, phantom view of one embodiment of a module as used in the fluid retention or detention system of the present invention.
Figure 10B:
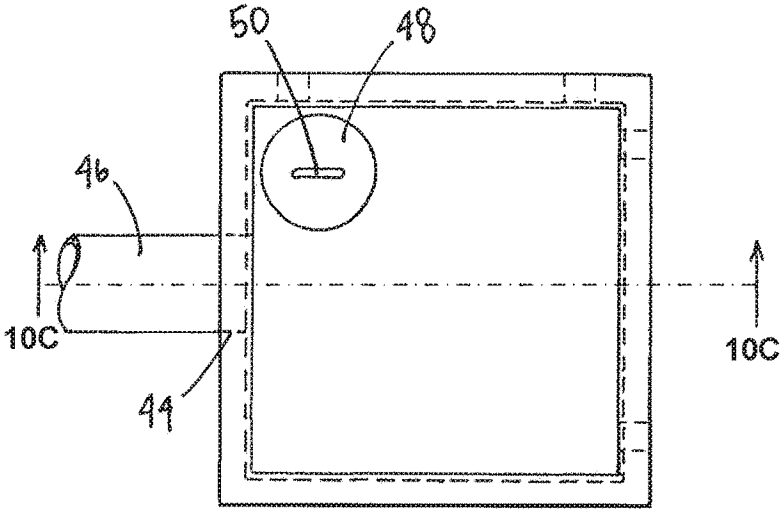
FIG. 10B is a top view of one embodiment of a module as used in the fluid retention or detention system of the present invention.
Figure 10C:
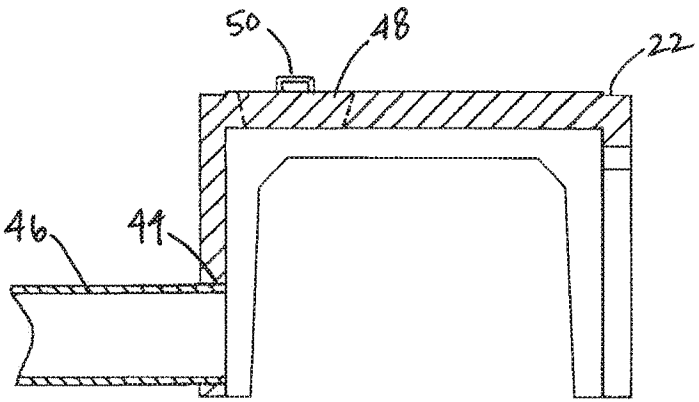
FIG. 10C is a side sectional view of one embodiment of a module as used in the fluid retention or detention system of the present invention taken along line 10C-10C.

The module depicted in FIGS. 8A-8AD has two side portions 24 which define a fluid passage 28 and two side portions which define a notch outlet 38. It will be understood that the notch outlet 38 can be used on modules having other configurations, such as a module having three side portions 24 which define a fluid passage 28 and one side portion which defines a notch outlet 38, a module having three side portions 24 which define a fluid passage 28 and one side portion which defines a notch outlet 38, a module having one or more perforate walls 34 and one side portion which defines a notch outlet 38.

As shown in FIGS. 9A-9D, the roof 22 of one or more modules may be provided with an inlet port 42 for the inflow of storm water to the system. Each port is fluidly connected to a ground-level drain and its associated conduit, if necessary. The location of the module(s) having the inlet port(s) 42 and the location of the port 42 on the particular module is not limited to particular locations. Rather, the location may be specifically customized as required by the preferred site requirements to allow for the direct inlet of the storm water into the assembly. For example, the location of these ports 42 may be pre-formed during the manufacture of the module if the preferred location is known, or, alternatively, the ports may be formed during installation of the system using appropriate tools.

Side port 44 (shown in FIG. 9C) may be used for inlet or outlet and may be fitted with a pipe 46 to receive or divert water to remote locations of the site. The side port(s) 44 can be provided in various locations and elevations in one or more side portions 24 within the system 10. In addition, the size and number of the ports 44 may be customized for inlet or outlet. For example, a larger port 44 is desirable for an inlet to allow fluid to enter the system 10 as quick and as unimpeded as possible. However, the size of an outlet could vary depending on how quickly it is desired for the fluid to leave the system 10. One having skill in the art would recognize that, for outlet purposes, the smaller the port 44 and/or pipe 26, the slower the fluid would escape the system, and vice versa.

As shown in FIGS. 10A-10D, an access cover 48 or "manhole" cover may be disposed in the roof 22 of a module. One or more modules within the system 10 may be provided with an access port 48 to allow access to the interior of the system 10 for drawing-off of stored fluid, maintenance, cleaning, if necessary, etc. The cover is lifted by means of a ring 50.

Figure 11:
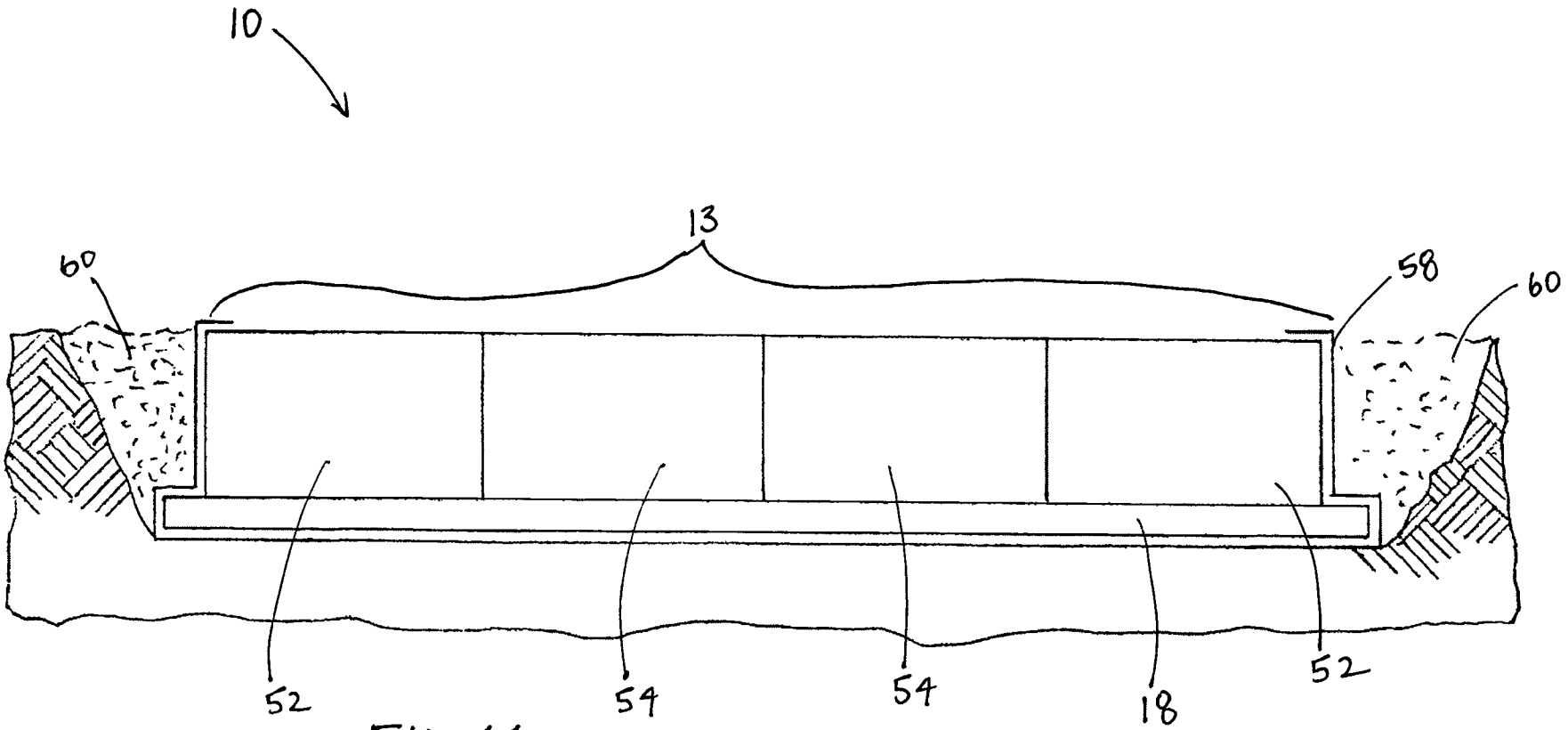
FIG. 11 is a side sectional view of one embodiment of the fluid retention or detention system of the present invention.
Figure 12:
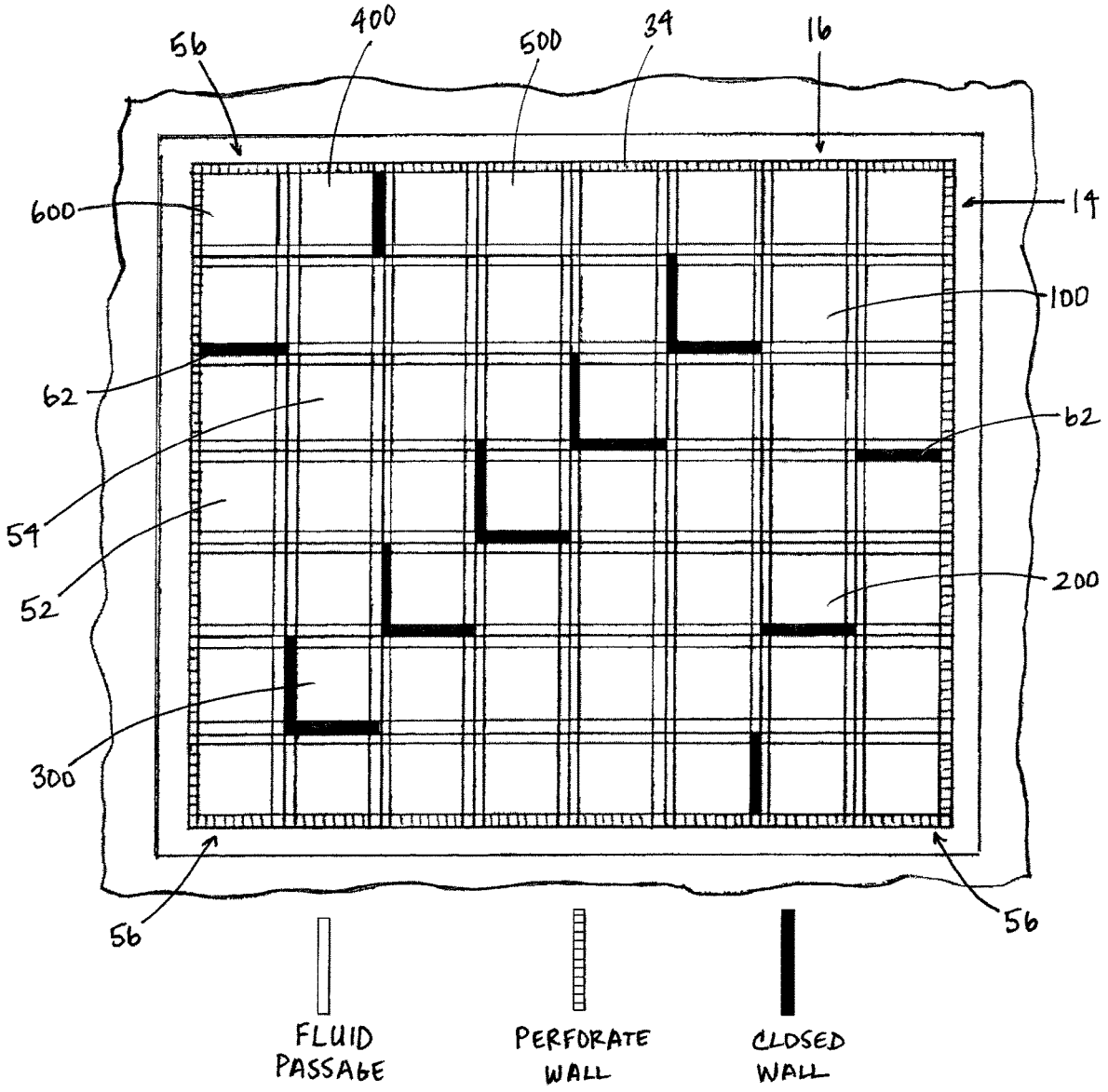
FIG. 12 is a top view of one embodiment of the fluid retention or detention system of the present invention, showing the layout of the modules within the system.

In operation, a hole is excavated in the earth where the system 10 is to be installed. As briefly described above with respect to FIG. 1, the modules 12 are individually installed and arranged beneath the ground in an assembly 13 having a plurality of rows 14 and columns 16. Each module 12 is in fluidly connected, either directly or indirectly, with the other modules in the assembly 13. Illustrated in FIG. 11, exterior modules 52 are peripherally located with respect to interior modules 54. The above-described types of modules 100-600 may be arranged as exterior 52 and/or interior modules 54 in a variety of assembly configurations and can be customized to fit the requirements of the project and restrictions of the space in which the system 10 is to be installed. FIG. 12 shows a top schematic view of one possible assembly configuration.

In the case of a system 10 designed for retaining or detaining a fluid, the assembly 13 is preferably placed on a concrete floor 18, which is usually poured into the bottom of the excavated hole before the modules are installed. Concrete slabs may also be pre-cast offsite beforehand and installed as a base for the modules. Alternatively, a water-tight liner 58 or membrane may form the floor of the assembly 13. The floor may be impervious except for an outlet port, such as a drain.

In the case of a system 10 designed for exfiltration of a fluid, the assembly 13 may be placed on an aggregate material or filter fabric material, rather than a concrete floor 18, to allow all or a portion of the fluid to be absorbed by the soil. The aggregate material may comprise any conventional material having a suitable particle size which allows the storm water to percolate into the earth layers beneath the assembly 13 at whatever flow rate is desired. Various filter fabrics may also be used. Alternatively, the entire system 10 could be sealed with a water-tight liner 58 (shown in FIG. 11), to selectively close the perforations 36 so that the system 10 could be used for fluid storage.

The plurality of modules 12 may be positioned in the ground at any desired depth. For example, the topmost portion of the assembly may be positioned at the ground level so as to form a traffic surface for a parking lot or foot-traffic. Alternatively, the modules may be positioned within the ground, underneath one or more layers of earth. In either case, the modules are sufficient to withstand earth, wheel, or object loads. The modules are suited for numerous applications and may be located under lawns, parkways, parking lots, roadways, airports, railroads, or building floor areas. After the assembly 13 is arranged in the desired configuration, compacted soil 60 is back filled around and over the system 10. Road or other surface materials such as grass, landscaping, concrete, asphalt, stone, brick, etc. may then be applied over the compacted soil 60 as desired for the particular application.

The choice of exterior module 52 can adapt the system 10 of the present invention to indefinitely retain a fluid, temporarily detain a fluid for rate-controlled dispersal, or exfiltrate a fluid into the surrounding earth. For example, with modules 200 and 300 arranged as exterior modules 52 so that the solid walls 32 face the exterior of the assembly 10, the system 10 may be used as a storage basin to indefinitely retain a particular fluid.

With a combination of modules 400, 500 and/or 600 arranged as exterior modules 52 so that the perforate walls 34 having a plurality of perforations 36 face the exterior, the system 10 could, for example be used over a leaching bed to exfiltrate a fluid into the surrounding soil. Even further, a system 10 having one or more notch outlets 38 provided along the periphery, could be used for a rate-controlled release of fluid into the soil.

In general, modules 300, 400, or 600 would be provided as corner modules 56. It will be appreciated that many other configurations of modules 100-600 are possible and that the system can be customized for any number of purposes.

The arrangement of the interior modules 54 is also an important aspect of the present invention. As illustrated in FIG. 12, each of the plurality of rows 14 and columns 16 contains at least one flow obstructer 62. In the pictured embodiment, the flow obstructer 62 is a solid wall 32 having substantially no openings, as provided in modules 200, 300 and 400. It is appreciated that the flow obstructer 62 could alternatively be provided as a solid baffle within the desired module, or any other object which would prevent fluid flow through that individual module.

It was shown that forcing the fluid travelling through the assembly 13 to take a circuitous path through each row 14 and column 16 caused the fluid flow within the assembly to become turbulent. This turbulence acts to dislodge and break-up any debris lodged in the modules 12. Furthermore, by agitating the fluid as it moves through the assembly, the interior of the modules are cleaned, obviating the need to do so by hand. By providing a system 10 that is self-cleaning and resistant to clogging, the modules will be less susceptible to degradation and less maintenance of the system will be required.

Moreover, providing additional load-bearing walls, such as a solid baffle or solid wall, within the interior of the assembly 13 adds structural support to the system 10. Generally, underground storage systems known in the prior art only place modules having four completely open sides on the interior of the system in order to prevent impeding the flow of water through the system. In the present invention, interior modules in the system 10 may be provided with at least one baffle or solid wall 32, as provided in modules 200, 300 and 400. The prior art systems having completely open interiors are less structurally sound than the system of the present invention which provides load-bearing walls within the interior of the assembly.

As can be seen in FIG. 12, the outer profile or footprint of the module does not change among the different embodiments of the modules 100-600. Therefore, one type of module may be substituted for another without needing to change the overall arrangement of the plurality of modules 12 within the system 10. By providing a variety of modules, all having the same footprint, different combinations of modules can be used to easily create a system customized for the desired use. In addition to this versatility aspect, because the modules are all generally of the shame shape, manufacturing is greatly simplified.

Figure 13:
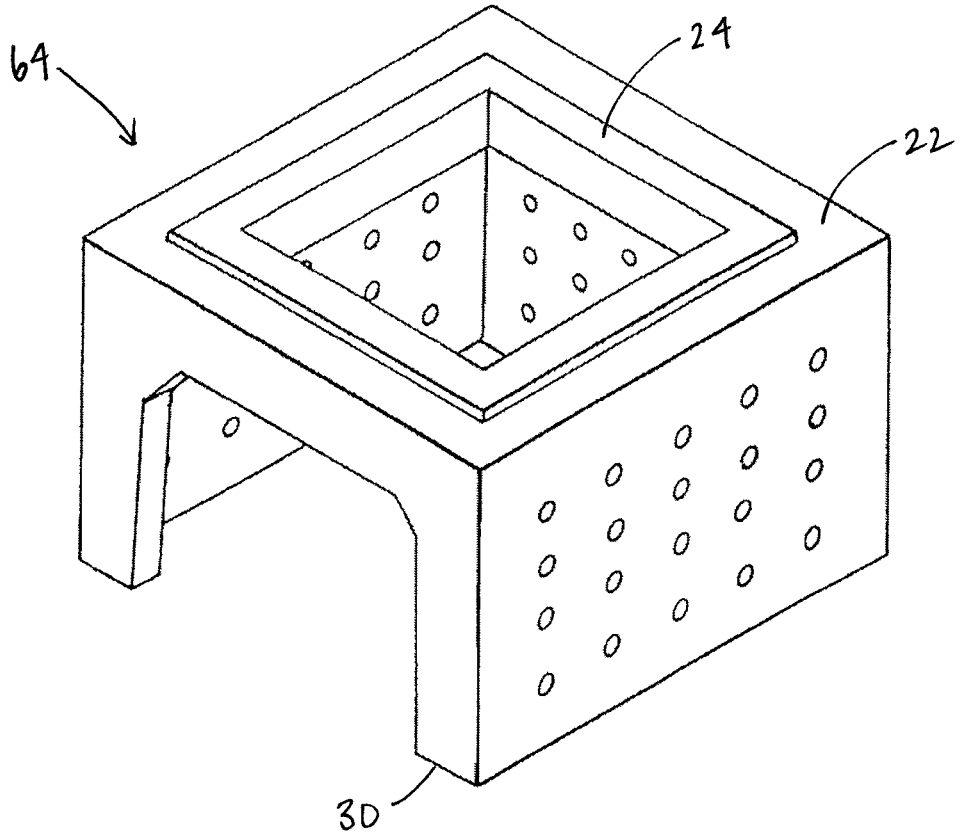
FIG. 13 is a perspective view of one embodiment of a module as used in the fluid retention or detention system of the present invention.
Figure 14:
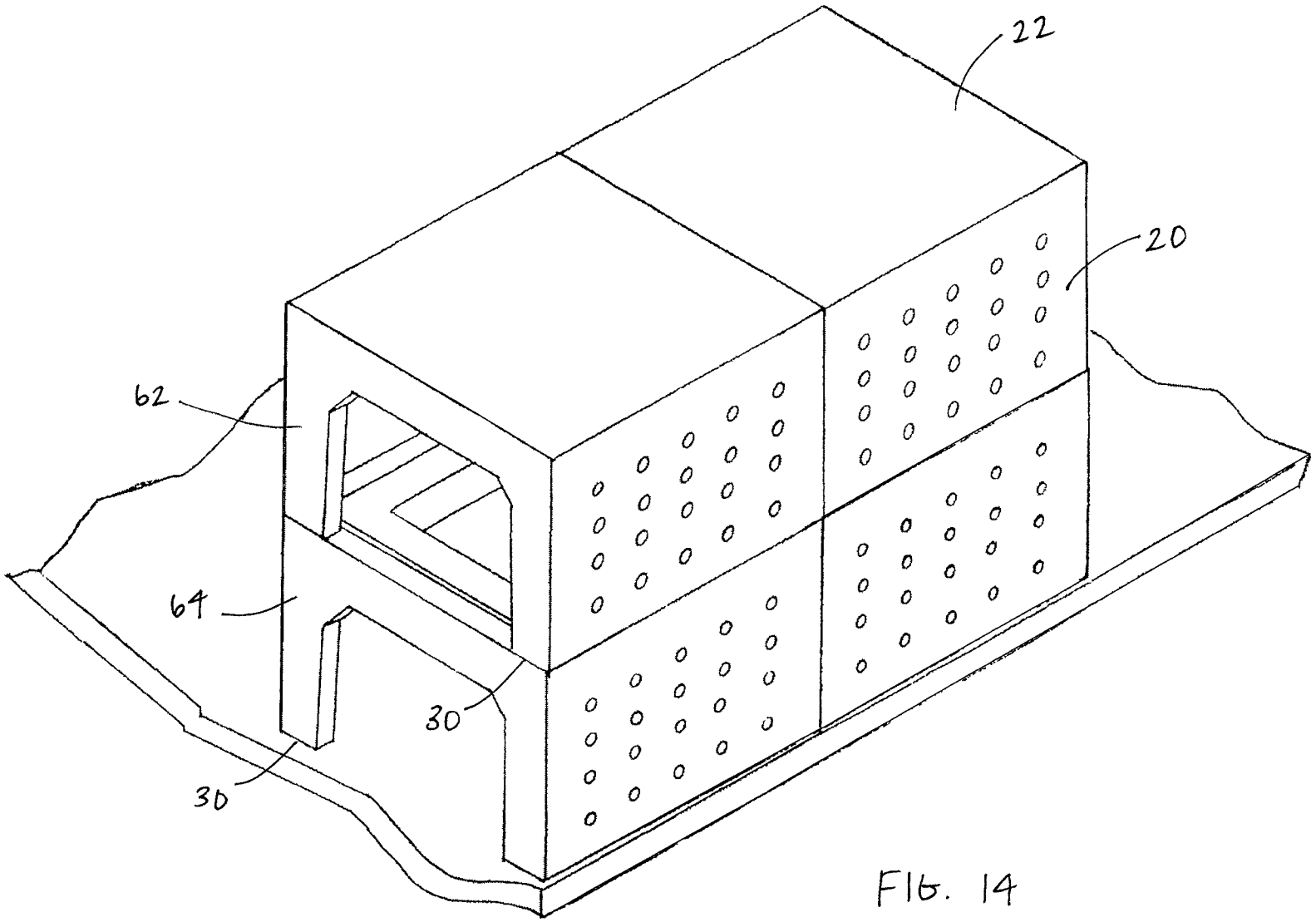
FIG. 14 is a perspective view of one embodiment of the fluid retention or detention system of the present invention, showing two layers of modules.

Referring now to FIGS. 13 and 14, the modules 12 may be arranged in a single level or single depth, or alternatively, may be arranged in multiple levels or multiple depths. The upper modules 62 are stacked on top of the lower modules 64, preferably in vertical alignment relative to each other. FIG. 13 shows one embodiment of a lower module 64 in which the roof 22 is open in the center to fluidly communicate with an upper module 64. Additionally, raised portion 24 of the roof 22 is provided to stabilize an upper module 64 when it is stacked on the lower module 64. The bottom edge 30 of the upper module 62 fits around the raised portion 24 of the lower module 64, thus preventing lateral or longitudinal motion of the upper module.

This aspect of the invention is significant because the volume of the system may be increased by extending further vertically into the earth, rather than horizontally along the surface area, saving space and money. It will be appreciated that the modules used in a multiple-depth configuration may be in any of the module embodiments 100-600 described above.

It should be understood that the foregoing is illustrative and not limiting, and that obvious modifications may be made by those skilled in the art without departing from the spirit of the invention. Accordingly, reference should be made primarily to the accompanying claims, rather than the foregoing specification, to determine the scope of the invention.

What is claimed is:

1. A fluid retention or detention system comprising:

a plurality of interior modules, each interior module having at least one vertically disposed side portion supporting a horizontally disposed roof each said side portion having a bottom edge; and a plurality of exterior modules, each exterior module having at least one vertically disposed side portion supporting a horizontally disposed roof;

each of said plurality of interior modules having at least one side portion defining a fluid passage extending therethrough, each said fluid passage extending upward from the bottom edge of said side portion;

said plurality of interior and exterior modules being arranged in an assembly in a plurality of rows and columns, said plurality of exterior modules being peripherally located in said assembly with respect to said interior modules so as to define a boundary of the assembly;

each of one or more of the plurality of the interior and exterior modules in the assembly being in fluid communication, either directly or indirectly, with each of the other of the one or more of the plurality of interior and exterior modules; and a plurality of flow obstructers located in said plurality of interior modules such that at least one flow obstructer is located in each of: said rows of said plurality of interior modules, or said columns of said plurality of interior modules, or said rows and said columns of said plurality of interior modules;

wherein the plurality of flow obstructers cause circuitous fluid flow through said one or more of the plurality of interior modules.

2. The fluid retention or detention system of claim 1 wherein at least some of said boundary modules each have at least one side portion defining no openings except for an inlet port or outlet port and at least one side portion defining a fluid passage extending therethrough.

3. The fluid retention or detention system of claim 2 wherein at least some of said boundary modules each have at least two side portions defining no openings except for an inlet port or outlet port and at least one side portion defining a fluid passage extending therethrough.

4. The fluid retention or detention system of claim 1 wherein side portions of at least some of said plurality of exterior modules define no openings except for an inlet port or outlet port face the exterior of said assembly.

5. The fluid retention or detention system of claim 1 wherein each said fluid passage has an inverted U-shaped cross section.

6. The fluid retention or detention system of claim 1 wherein each module is formed from precast concrete.

7. The fluid retention or detention system of claim 6 wherein each said fluid passage has an inverted U-shaped cross section.

8. The fluid retention or detention system of claim 1 wherein said assembly is supported on an impermeable floor.

9. The fluid retention or detention system of claim 1 wherein said assembly is supported on a floor having at least one outlet port defined therein.

10. The fluid retention or detention system of claim 1 wherein at least one of said plurality of interior modules has two side portions having no openings.

11. The fluid retention or detention system of claim 1 wherein at least some of said boundary modules each have at least one side portion defining a plurality of perforations.

12. The fluid retention or detention system of claim 11 wherein at least some of said boundary modules each have at least two side portions defining a plurality of perforations.

13. The fluid retention or detention system of claim 1 wherein said horizontally disposed roof of said plurality of interior modules and said plurality of exterior modules are all of a substantially identical area.

14. The fluid retention or detention system of claim 1 wherein said rows and columns are each defined through a common center line of said fluid passage of at least two of said plurality of interior modules.

15. The fluid retention or detention system of claim 14 wherein said common centerline corresponding to said rows is transverse to the common center line of said columns.

* * * * *